US006059883A

United States Patent [19]

Tuttle

[11] Patent Number: 6,059,883

[45] Date of Patent: May 9, 2000

[54] SEALANT APPLICATOR

[76] Inventor: Scott M. Tuttle, 3120 N. Bluff Ct., Hudsonville, Mich. 49426

[21] Appl. No.: 09/079,017

[22] Filed: May 14, 1998

Related U.S. Application Data

[60] Provisional application No. 60/046,547, May 15, 1997.

[51] Int. Cl.[7] ..... B05C 3/00; B05C 13/00

[52] U.S. Cl. ..... 118/501; 118/500; 118/504; 118/429

[58] Field of Search ..... 118/500, 501, 118/504, 428, 429, 100, 121, 404, 406, 423, DIG. 11, DIG. 13; 427/284, 430.1, 355, 356; 401/9, 122

[56] References Cited

U.S. PATENT DOCUMENTS 3,889,628 6/1975 Usab ..... 118/3
5,180,241 1/1993 Gueret ..... 401/122

*Primary Examiner*—Shrive Beck
*Assistant Examiner*—Jennifer Calcagni
*Attorney, Agent, or Firm*—Waters and Morge, P.C.

[57] ABSTRACT

A sealant applicator is used with a sealant container and has a frame, a plug contained within the frame, a wiper connected with a first frame end, a biasing member connected between the frame and the plug, and a coupler that couples the sealant applicator with the sealant container. The frame has first and second opposing frame ends and defines a pathway between the opposing frame ends. The plug slides between the opposing frame ends along the pathway. The wiper wipes a portion of the plug when the plug slides to the first frame end. The biasing member biases or urges the plug toward the first frame end. The sealant applicator extends within the sealant container when coupled with the container. In other aspects, the plug further includes a tip and an opposing base, the plug is oriented with the base facing the second frame end, and the tip includes at least one of a group that includes a convex surface and a concave surface. The plug further may include a shelf that is located between the tip and base and has a surface that faces away from the second frame end, the surface being one of a group of surfaces that includes concave and convex surfaces.

10 Claims, 2 Drawing Sheets

SEALANT APPLICATOR

CROSS-REFERENCES TO RELATED APPLICATIONS

This is a continuation in part application of co-pending U.S. Patent Provisional Application Ser. No. 60/046,547, entitled Sealant Applicator and filed on May 15, 1997, by Scott M. Tuttle, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to threaded pipe connections and the like. More particularly, the invention relates to applying a sealing agent to external threads of a pipe.

In the process of assembling piping systems (natural gas piping, and water piping for fire sprinklers, for example )threaded pipe connections are often used. For some systems, a Teflon tape may be applied to external pipe threads to facilitate screwing components together. In other systems, the use of a pipe thread compound, or "pipe dope" as it has been called, may be required to provide a more stable joint. The thread compound is a paste-like material that is applied to clean external pipe threads just prior to joint assembly. The thread compound provides three basic benefits to a threaded pipe joint. First, it lubricates the threads to ease assembly. Second, it is a sealant that enhances the gas-tightness or fluid-tightness of the resulting joint. And third, it hardens or cures to effectively cement and stabilize the joint.

The process of applying pipe thread compound has basically not changed since its original utilization, however. Pipe thread compound is commonly packaged in tins, or cans, of varying size, so one may purchase a quantity that is appropriate to the task at hand. The packaging will typically, though not always, include an applicator brush. The common method of applying pipe thread compound is to acquire a portion of the compound from the tin with the brush, and apply the compound to external pipe threads by brushing. This method does not, however, assure a uniform application of the compound, either over the threads of one fitting or from joint to joint. Also, the amount of compound used is not regulated or controlled, so too much or too little compound may be used. Each of these situations compromises the quality, the durability and reliability, of the resulting threaded pipe joint.

Thus, one realizes that the quality of a threaded pipe joint is highly dependent upon the skill or craftsmanship of the user, the pipe -fitter. Further, one realizes that a device to provide a uniform application of an appropriate quantity of pipe thread compound will greatly benefit the quality of threaded pipe joints.

BRIEF SUMMARY OF THE INVENTION

Accordingly the invention of sealant applicator a addresses the problems of inconsistent quality in threaded pipe joints.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
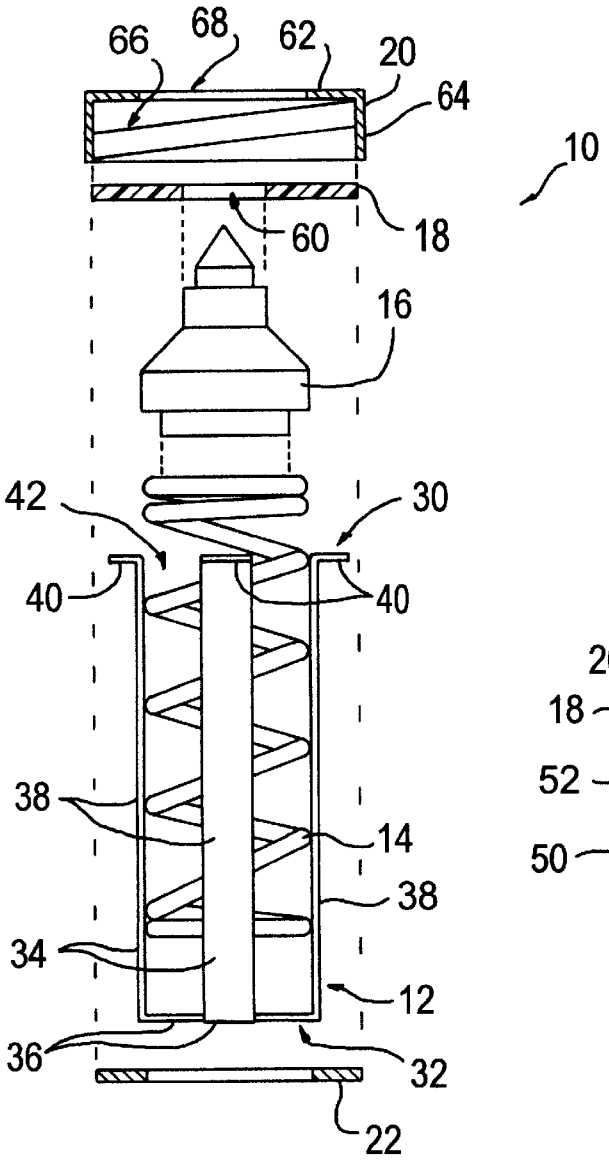
FIG. 1 is an exploded elevational view of a sealant applicator according to the invention.
Figure 2:
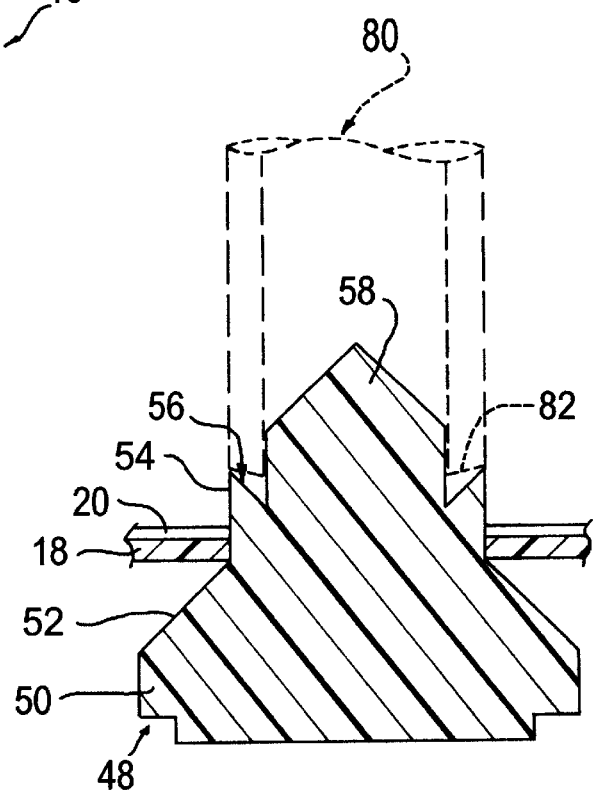
FIG. 2 is an enlarged, cross-sectional detail of a plug of the applicator of FIG. 1.

A sealant applicator according to the invention is generally shown in the drawing figures and identified by the reference number 10. The sealant applicator is particularly useful for applying a joint sealant to the external threads of a pipe that is to be coupled with other components in a threaded pipe joint. One having ordinary skill in the art will know that the threaded pipe joint sealing compound is commonly referred to as "pipe dope". The applicator 10 has a frame 12 that houses a biasing spring 14, has a plug 16, has a wiper 18, has a cap 20, and has a retainer 22.

The frame 12 is an open frame with two opposing frame ends 30 and 32. The frame 12 may be constructed by any of various commonly known methods in various configurations, with any suitable structural material. In one configuration of the frame 12, as shown, the frame includes two generally U-shaped frame members 34. Each frame member 34 has a bite portion 36 and two legs 38 that extend in the same general direction from the bite portion 36 to a terminal end that has a flange portion 40. The flange portion 40 is bent generally perpendicular to the leg 38 in a direction generally away from the other leg 38. The two frame members 34 are assembled into the frame 12 by positioning the bite portions 36 of the two frame members 34 in abutting engagement to define an X, with the four legs 38 extending in the same general direction and each leg 38 being spaced equally apart from the adjacent legs 38 of the other frame member. It is noted that the frame members 34, shown in the drawing figures, comprise flat, strip members, possibly made of tin for example. It is also noted the frame members 34 may also comprise other configurations, including generally U-shaped wire members, for example. However the frame 12 is specifically constructed, the frame 12 preferably has first and second opposing ends 30 and 32 and defines a pathway 42 between the two opposing ends.

The helical coil spring 14 or the like is positioned in the pathway 42, between the four legs 38 of the frame 12. The plug 16 engages one end of the spring 14, at the first end 30 of the frame 12. The plug 16 may also be constructed by any of various commonly known methods in various configurations, with any suitable structural material, including a nylon plastic, for example. The plug 16 is generally circular at any cross section, and may be cast, molded, or turned of metal or plastic, for example. The plug 16 has a generally cylindrical base 50 with a circumferential notch 48, so at least a portion of the base 50 may be inserted into an end coil of the spring 14 in force-fit engagement, to couple the spring 14 and the plug 16 together and to provide stability to the plug 16 during use. From the base 50, an about 45 degree taper 52 extends to a generally cylindrical mid-body portion 54. The taper 52 extends radially inward about 0.2 inches (5 mm) from the base 50 to the mid-body 54. The mid-body 54 extends from the taper 52 to a reverse taper shelf 56. The reverse taper shelf 56 extends radially inward about 0.125 inches (3 mm) from the mid-body portion 54 to a tip 58 of the plug 16, opposite the base 50. The tip 58 may have a generally cylindrical portion that terminates in an about 45 degree conic end surface, or a hemispherically shaped end surface, for example. The tip 58 is, however, preferably not square cut, defining a flat end, to enhance use of the sealant applicator 10, as is described further below. The reverse taper 56 is provided to enhance sealing of the plug 16 against the end of a pipe and to protect the end thread of a pipe, as is discussed further below.

The plug 16 may be dimensioned for use with one pipe size, or for use with a range of pipe sizes. For use with one pipe size, the cylindrical portion of the tip 58 will have a diameter that is slightly smaller than the inside diameter of a pipe 80 that will be used with the applicator 10. The mid-body portion 54 preferably has a diameter that is about the same as the outside diameter of the pipe 80. The reverse taper 56 extends between the tip 58 and the mid-body portion 54, as discussed above.

The wiper 18 is constructed of any durable, pliable material, including a polyurethane or polyvinylchloride plastic, for example. The wiper 18 is a generally circular disk member with a generally circular aperture 60 centered in the disk. Thus, the wiper 18 has the general appearance of a commonly known washer. The aperture 60 is preferably sized to snugly fit around the plug mid-body portion 54 to effectively wipe the outside of a pipe, as is discussed further below.

The cap 20 has a circular disk portion 62 with a perimeter flange 64 that extends generally perpendicular to the disk portion. The flange 64 has internal threading 66 that is adapted to correspond to and couple with a threaded neck that is commonly found on bottles of pipe dope. The disk portion 62 of the cap 20 has a large, centered, circular aperture 68. The aperture 68 may be about twice as large as the aperture 60 that is in the wiper 18. The aperture 68 should be sized so the wiper may be captured between the cap 20 and the retainer 22, and yet so the cap 20 will not restrain the wiper 18 and allow the wiper 18 to flex into the aperture 68 for effective wiping of the exterior and the threads of the pipe 80.

Finally, the retainer 22 captures the wiper 18, plug 16, spring 14 and frame 12 in the cap 20. The retainer 22 may also be constructed with various configurations, of various structural materials. One fabrication of the retainer 22 is a metal member that has the appearance of a commonly known, external tab, star washer (also known as a lock washer), as will be understood by one having ordinary skill in the art.

In the course of making a threaded pipe connection, one will commonly coat the external threads of a pipe or fitting, with pipe dope, prior to screwing the threaded connection together. The pipe dope is used to lubricate the connector for assembly and to seal the completed connection. Use of too little pipe dope may cause inadequate lubrication or an inadequate seal. Use of too much pipe dope may cause some of the pipe dope to seap into the pipe or fitting to restrict the passageway through the connection. Thus, the use of the correct amount of pipe dope is important to a good connection. To apply the pipe dope with the applicator 10, the cap of a commonly available bottle of pipe dope is removed and replaced with the applicator 10 by inserting the frame 12, including spring 14 and plug 16 into the bottle and securing the applicator 10 tight in the bottle, with cap 20. So installed, a user will simply "stab" a length of pipe into the bottle of pipe dope that is equipped with the applicator 10. More specifically, a threaded end of pipe 80 is positioned over the plug tip 58 with the very end, or first thread of the pipe 80 seating at reverse taper shelf 56. The pipe 80 is thrust generally downward, through cap aperture 68 and wiper aperture 60, pushing the plug 16 into the bottle and compressing the spring 14 against the second end 32 of the frame 12. Upon entry through the wiper 18 and into the bottle, the exterior of the pipe 80 becomes emersed in the pipe dope that is contained within the bottle. It is noted, that the pipe dope does not enter the hollow of the pipe, because the end of the pipe is plugged by being seated around plug tip 58, and in the reverse taper shelf 56. Thus, the interior of the pipe 80 is kept clean for a good, clear connection. After being stabbed into the bottle of pipe dope as just discussed, the pipe is withdrawn from the bottle, out through the wiper 18 and the cap 20. As the pipe 80 is withdrawn, the wiper wipes excess pipe dope from the exterior of the pipe 80 and leaves the pipe threads filled with a proper quantity of pipe dope to provide a good, clean, tight, threaded pipe connection.

Figure 3:
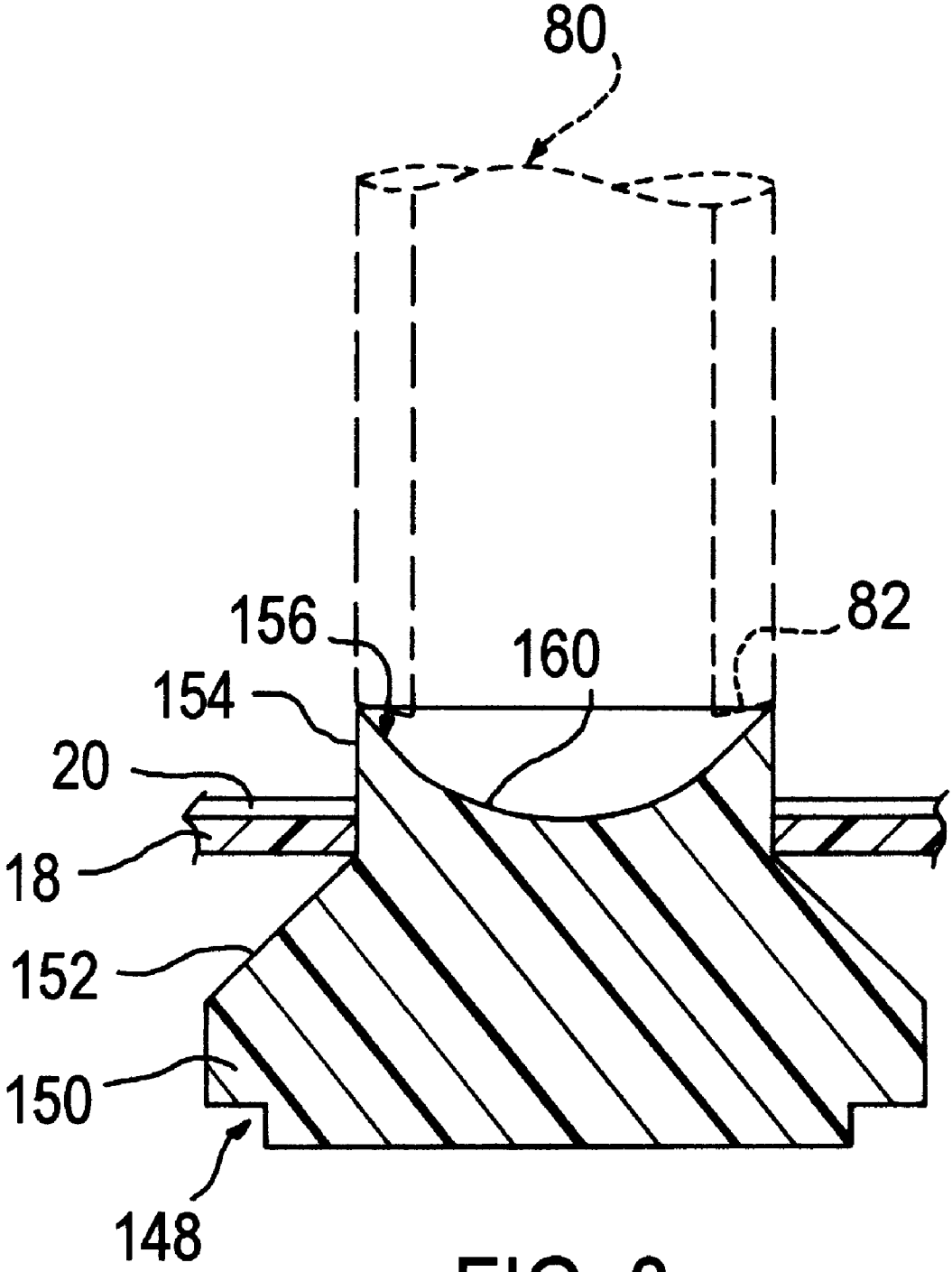
FIG. 3 is the view of FIG. 2, showing an alternative embodiment of a plug of the applicator.

An alternative embodiment plug 116 of the plug 16 is shown in FIG. 3, without the tip 58. The plug 116 is otherwise substantially the same as plug 16, and may also be constructed by any of various commonly known methods in various configurations, with any suitable structural material, including a nylon plastic, for example. The plug 116 is generally circular at any cross section, and may be cast, molded, or turned of metal or plastic, for example. The plug 116 has a generally cylindrical base 150 with a circumferential notch 148, so at least a portion of the base 150 may be inserted into an end coil of the spring 14 in force-fit engagement, to couple the spring 14 and the plug 116 together and to provide stability to the plug 116 during use. From the base 150, an about forty-five degree taper 152 extends to a generally cylindrical mid-body portion 154. The taper 152 extends radially inward about 0.2 inches (5 mm) from the base 150 to the mid-body 154. The mid-body 154 extends from the taper 152 to a reverse taper shelf 156. The reverse taper shelf 156 extends radially inward as a sidewall of a concave surface 158, opposite the base 50. The concave surface 158 may have a generally cylindrical, conic, or flat bottom surface 160, for example. The specific contour of the bottom surface 160 may be determined by desired production methods of a manufacturer, for example. The reverse taper 156 is provided to enhance sealing of the plug 116 against the end of a pipe and to protect the end thread of a pipe, as is discussed above regarding the plug 16.

One having ordinary skill in the art, and those who practice the invention, will understand that the applicator 10 may be made to accommodate different size pipes and may also be constructed to accommodate a range of pipe sizes. It will be further understood that various modifications and improvements may be made to the invention without departing from the spirit of the disclosed concept. The scope of protection afforded is to be determined by the claims and by the breadth of interpretation allowed by law.

I claim:

1. A sealant applicator that is used with a sealant container, the sealant applicator comprising:

a frame, the frame having first and second opposing frame ends, the frame defining a pathway between the first and the second frame ends;

a plug operatively connected with the frame, the plug being slidable between the opposing frame ends along the pathway;

a wiper connected with the first frame end, the wiper wiping a portion of the plug when the plug slides to the first frame end;

a biasing member operatively connected between the frame and the plus, the biasing member biasing the plug toward the first frame end; and a coupler that couples the sealant applicator with the sealant container, with the sealant applicator extending within the sealant container.

2. The sealant applicator defined in claim 1, wherein the plug further includes a tip and an opposing base, wherein the plug is oriented with the base facing the second frame end, and wherein the tip is selected from the group consisting of a convex surface and a concave surface.

3. The sealant applicator defined in claim 2, wherein the plug further includes a body portion, wherein the body portion extends at least partially between the base and tip, and wherein the body portion terminates at a shelf and extends from the shelf toward the base.

4. The sealant applicator defined in claim 3, wherein the shelf extends generally radially inward from the body portion and is selected from the group consisting of convex and concave surfaces.

5. The sealant applicator defined in claim 1, wherein the plug further includes two opposing ends and a shelf, the shelf being located between the two opposing ends and having a surface that faces away from the second frame end, the surface being selected from the group consisting of concave and convex surfaces.

6. The combination of a sealant container and a sealant applicator, comprising:

a container, the container having a perimeter wall, have an interior volume defined within the wall, and having a mouth that defines a passage from the interior volume to outside the container;

a frame, the frame having opposing first and second frame ends, the frame extending into the interior volume from the first frame end at the mouth, to the second frame end in the interior volume, the frame also defining a path between the first and second frame ends;

a plug that slides along the path, the plug having a tip and an opposing base, the plug being oriented so the base faces the second frame end, the tip being adapted to releasably receive an end of a length of pipe in abutting sealing engagement;

a bias member, the bias member being operatively connected with each of the plug and the frame and biasing the plug toward the first frame end; and a wiper at the first frame end, the wiper extending between the container and the plug in sealing engagement when the plug is positioned at the first frame end.

7. The sealant applicator defined in claim 6, wherein the tip is selected from the group consisting of a convex surface and a concave surface.

8. The sealant applicator defined in claim 7, wherein the plug further includes a body portion, wherein the body portion extends at least partially between the base and tip, and wherein the body portion terminates at a shelf and extends from the shelf toward the base.

9. The sealant applicator defined in claim 8, wherein the shelf extends generally radially inward from the body portion and is selected from the group consisting of convex and concave surfaces.

10. The sealant applicator defined in claim 6, wherein the plug further includes two opposing ends and a shelf, the shelf being located between the two opposing ends and having a surface that faces away from the second frame end, the surface being selected from the group consisting of concave and convex surfaces.

* * * * *